US005377521A

United States Patent [19]

Mackey

[11] Patent Number: 5,377,521

[45] Date of Patent: Jan. 3, 1995

[54] METHOD FOR PROPELLER STRAIGHTENING

[75] Inventor: James C. Mackey, Seattle, Wash.

[73] Assignee: Lips Propellers, Inc., Chesapeake, Va.

[21] Appl. No.: 207,589

[22] Filed: Mar. 8, 1994

Related U.S. Application Data

[62] Division of Ser. No. 926,835, Aug. 7, 1992, Pat. No. 5,315,856.

[51] Int. Cl.[6] ..... B21D 5/01

[52] U.S. Cl. ..... 72/374; 72/389; 72/455; 29/889.1; 29/447

[58] Field of Search ..... 29/889.1; 72/389, 390, 72/455, 456, 374, 379.2, 447

[56] References Cited

U.S. PATENT DOCUMENTS

| | | | |
|---|---|---|---|
| 3,990,291 | 11/1976 | Evertz et al. | 72/382 |
| 4,671,094 | 6/1987 | Break | 72/319 |
| 5,022,248 | 6/1991 | Brooks et al. | 72/21 |
| 5,315,856 | 5/1994 | MacKey | 72/389 |

FOREIGN PATENT DOCUMENTS

| | | | |
|---|---|---|---|
| 0103918 | 6/1983 | Japan | B21D 5/02 |
| 0171219 | 7/1988 | Japan | B21D 7/06 |
| 2099734 | 12/1982 | United Kingdom | B21D 7/06 |

*Primary Examiner*—David Jones
*Attorney, Agent, or Firm*—Seed and Berry

[57] ABSTRACT

A method of using an apparatus for straightening a propeller having an arbor press with two opposed inner surfaces. The opposed surfaces are spaced apart a sufficient distance to allow a propeller to fit between them with one opposed surface extending beyond the second opposed surface. Two pads are mounted on the first inner surface to support the propeller during the straightening procedure. One or both of the pads may be adjustable to more precisely locate the points of pressure that will be applied to the propeller to straighten it. A ram is mounted on the second inner surface to apply pressure to the propeller. A reinforcing ridge may be attached to the outer surface of the arbor press to provide rigidity during the propeller straightening procedure. To allow precision manipulation of the device under water, a floatation collar is fixed to the arbor press or the reinforcing ridge. The floatation has sufficient buoyancy to counteract the weight of the apparatus when under water. To prevent instability in the apparatus when under water, the floatation collar is positioned so that the center of buoyancy substantially coincides with the center of gravity. In one embodiment, a pair of reinforcing ridges and a cover may be used to define a water-tight enclosure. The pair of ridges provide reinforcement and the water-tight enclosure provides additional buoyancy. In operation, a single diver may manipulate the apparatus so that a bent portion of the propeller is between the opposed inner surfaces of the arbor press so that one side of the propeller rests against the pads. The ram is activated and the piston head of the ram applies pressure to the other side of the propeller to straighten the propeller. The apparatus may be manipulated by a single diver and eliminates the need for dry-docking a ship to straighten the propeller thus reducing the cost of repair and speeding up the repair process.

15 Claims, 4 Drawing Sheets

METHOD FOR PROPELLER STRAIGHTENING

CROSS-REFERENCE TO RELATED APPLICATION

This application is a division of U.S. Pat. application Ser. No. 07/926,835, filed Aug. 7, 1992, now U.S. Pat. No. 5,315,856.

TECHNICAL FIELD

The present invention relates generally to propeller repair, and specifically to propeller straightening.

BACKGROUND OF THE INVENTION

International commerce requires the transportation of goods throughout the world. In the present world economy, an increasing supply of goods are transported on ships. Many of the ships used to transport goods are large ocean-going ships. One unfortunate result of the increase in ship traffic is an increase in ship damage due to collisions or running aground. Some of these accidents require major repairs, which forces the ship to be placed in a dry-dock for repairs. Dry-docking a ship is a very costly procedure that is unavoidable in accidents requiring major repairs.

However, some accidents do not require major repairs. Often the only damage sustained by a ship running aground or striking a floating log is a bent propeller. The repair of a propeller itself may be a simple task, but there is presently no device that easily can repair the propeller under water. Some prior art attempts to repair a propeller under water involve a wrench and a long pry bar, but there is no readily available position from which to exert a force on the pry bar. Therefore, the ship must be placed in dry-dock to effect repairs even though the repair itself may be simple. Once the ship is placed in dry-dock and the water drained away from the ship, the propeller may be straightened by pressing it back into its original shape. The cost of the repair is relatively small when compared to the cost of placing the ship in dry-dock. Furthermore, the ship is taken out of service for a prolonged period of time in order to place it in dry-dock. The cost of removing a ship from service may exceed the cost of placing the ship in dry-dock If the propeller is removed or repaired in dry-dock, prior art attempts to repair a propeller often involve heating and bending the propeller, often with a large press ill-suited for the task. Bent portions may be removed from the propeller because prior art equipment cannot straighten the propeller with the necessary precision.

Prior art attempts to use an arbor press for propeller straightening have failed because the arbor press typically has opposed inner surfaces of substantially equal length as seen in FIG. 1. This configuration applies pressure to the propeller between the ram 1 and a flat surface 2. Pressure is applied at only two points by the ram 1 and the pad 2. A large pressure is required to bend a propeller using an arbor press in this manner. Therefore, the arbor press must be large and have a significant amount of reinforcement to prevent the arbor press from shining when the ram 1 is activated.

Some machine shops place a long metal bar 3 on the flat surface 2 to extend the working surface and allow a large object such as a propeller to be straightened. The metal bar 3 is cumbersome and may not direct the forces in the desired manner. Some arbor presses use a large bench as the flat surface 2. This approach requires that the propeller be secured to the bench at a precise angle. All of the prior art approaches to propeller straightening are cumbersome and require a great deal of time. The propeller must be precisely manipulated, and the pressure applied by the ram 1 may not be adequately positioned to effectively straighten the propeller.

Therefore, it can be appreciated that there is a significant need for an apparatus and method for propeller straightening that may be used underwater.

SUMMARY OF THE INVENTION

The invention is embodied in an apparatus and method for straightening a propeller. The apparatus contains an arbor press with first and second opposed surfaces separated by a distance sufficient to allow a propeller to fit between the opposed surfaces with the first opposed surface extending beyond the second opposed surface. A first and second pads are spaced apart and mounted on the first surface to support one side of the propeller. A ram is mounted on the second surface to apply pressure to the other side of the propeller when activated.

For underwater propeller straightening, the apparatus has a flotation collar positioned about the arbor press to counteract the weight of the apparatus when under the water. The floatation collar has a center of buoyancy that substantially coincides with the center of gravity of the apparatus. This allows the apparatus to be easily manipulated under the surface of the water without toppling over.

In one embodiment, a pad on the first inner surface may be adjustable to allow more precise application of pressure to the propeller. A corrugated stop is mounted on the first inner surface in a fixed position. The adjustable pad has a corrugated bottom to mate with the corrugated stop to prevent the adjustable pad from shifting during the straightening procedure. A reinforcement ridge may be fastened to the outside of the arbor press to provide rigidity during the straightening procedure. The ram may be hydraulically operated.

DETAILED DESCRIPTION OF THE INVENTION

Figure 1:
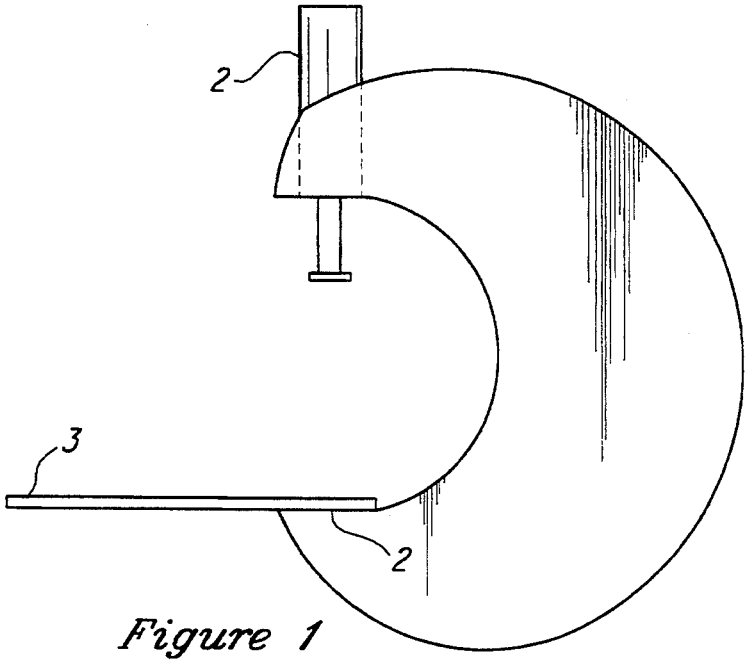
Figure 1 (Prior Art)
FIG. 1 shows a prior art arbor press.

The present invention allows a propeller to be precisely straightened with a single piece of equipment without the need for securing the propeller at a precise angle. The present invention also allows a propeller to be straightened underwater without the removal of the propeller from the ship or the dry-docking of the ship. The invention is embodied in an apparatus 10 shown in FIG. 2A. An arbor press 12 is used to straighten the propeller 38. The arbor press has a first inner surface 16 and a second inner surface 18 which are opposed to each other and separated by a distance that allows the bent portion of the propeller to be placed between the opposed inner surfaces 16 and 18. In the presently preferred embodiment, the arbor press 12 is made of single piece of ¾ inch ferralium alloy 255. This material is commercially available and has high tensile strength, is easy to weld, and requires no stress relieving after welding. Furthermore, the alloy is well suited to work in a salt water environment because it offers corrosion resistance. It is clear, however, that many other well suited materials exist. Therefore, the choice of materials in the presently preferred embodiment should not be viewed as a limitation.

The piece of ¾ inch ferralium alloy 255 is bent to form the opposed inner surfaces 16 and 18 with a spacing of approximately thirteen inches of separation between the opposed inner surfaces 16 and 18. This separation allows the repair of large propellers. Alternatively, the arbor press 12 may have a larger opening 13 or a larger throat 15, such as a C-shaped arbor press, to accommodate larger propellers. While the present embodiment uses a single piece of metal bent to form the arbor press 12, it is apparent that many suitable forms of construction may be used satisfactorily. The first inner surface 16 extends beyond the second inner surface 18. The advantages of this configuration will be discussed in detail below.

A reinforcing ridge 20 is affixed to the outer surface 14 of the arbor press 12. The reinforcing ridge may be made of the same material as the arbor press or some other suitable material. The reinforcing ridge 20 provides structural strength and rigidity to the arbor press 12 to prevent the opposed inner surfaces 16 and 18 from shifting when under pressure. Alternatively, the arbor press 12 may be constructed from material and have a shape that does not require the additional rigidity provided by the reinforcement ridge 20.

Figure 2A:
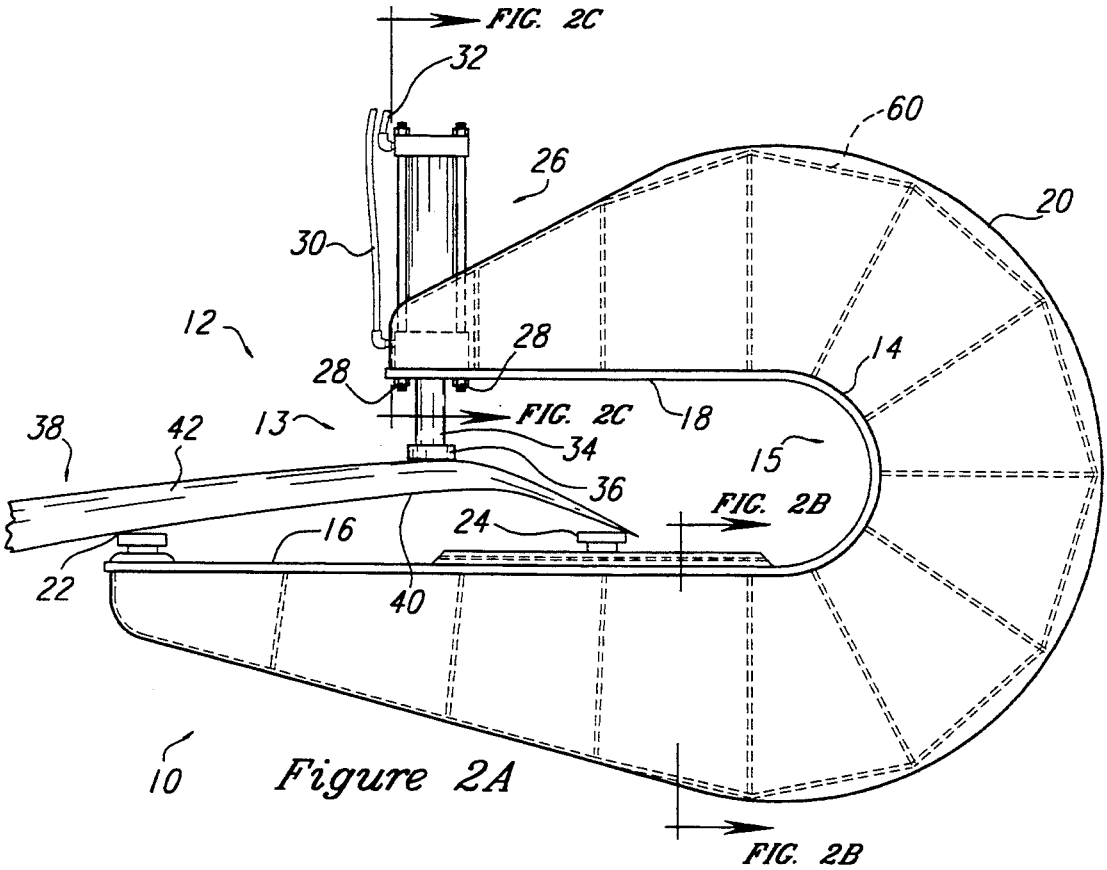
FIG. 2A is a side view of the present invention.
Figure 2B:
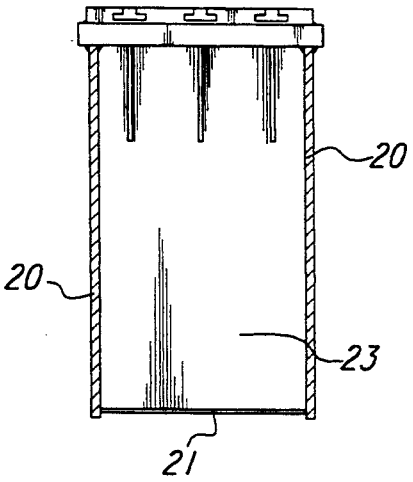
FIG. 2B is an end view of FIG. 2A.
Figure 2C:
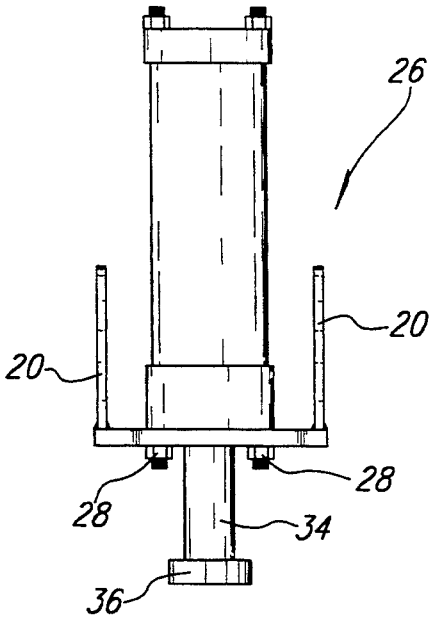
FIG. 2C is another end view of FIG. 2A.

In another embodiment, a pair of reinforcing ridges 20 may be used to provide additional reinforcement, as shown in FIG. 2B. FIG. 2B is an end view of FIG. 2A, taken along the line B—B. The reinforcement ridges 20 are located near the edges of the outer surface 14 of the arbor press 12. The reinforcing ridges 20 may be enclosed by a cover 21 to provide a water-tight enclosure 23. As will be described in detail below, the apparatus 10 is designed to have a buoyancy under the surface of the water to counteract the weight of the apparatus. The water-tight enclosure 23 provides additional buoyancy to counteract the weight of the apparatus 10 under the surface of the water.

The arbor press 12 has two pads 22 and 24 fastened to the first inner surface 16. The first pad 22 has a fixed position at one end of the first inner surface 16. The second pad 24 may be slidably mounted to the first inner surface 16. A detailed description of the second pad 24 is provided below. The pads 22 and 24 are spaced apart on the first inner surface 16 to provide support to the propeller 38 during the straightening process. The arbor press 12 is placed so that a bent portion of the propeller 38 rests against the pads 22 and 24. With a first side 40 of the propeller resting against the pads 22 and 24, pressure is applied to the second side 42 of the propeller 38 to straighten the propeller. The pads 22 and 24 provide a first and second pressure points on the first side 40 of the propeller 38 at the points where the pads contact the propeller.

A ram 26 is used to provide pressure against the second side 42 of the propeller 38. The ram 26 is mounted to the second inner surface 18 by bolts 28 or any suitable mechanical means of attachment. Alternatively, the ram 26 may be welded to the arbor press 12. In the presently preferred embodiment, the ram 26 is hydraulically activated by a first and second hydraulic lines 30 and 32, respectively. The use of hydraulics for operating the ram 26 is well known and will not be discussed herein. Alternatively, the ram 26 may be electrically operated or mechanically operated. If two reinforcing ridges 20 are used, the ram 26 may be mounted in between the two reinforcing ridges as shown in FIG. 1C. FIG. 1C is an end view of FIG. 1A, taken along the line A—A.

When the arbor press 12 is placed about a bent portion of the propeller 38, the first side 40 of the propeller 38 rests against the pads 22 and 24, as previously described. The operator activates the ram 26 so that a ram piston 34 extends toward the second side 42 of the propeller 38. A piston head 36 makes contact with the second side 42 of the propeller 38 to create a third pressure point on the propeller 38 at the point where the piston head 36 contacts the propeller. As the piston head 36 presses against the second side 42 of the propeller 38, the propeller is straightened by the pressure applied by the piston head 36 and the pads 22 and 24. It should be noted that damage suffered by a propeller is unpredictable. It is possible that the nature of the damage may not allow the first side 40 of the propeller 38 to rest against the pads 22 and 24. However, as the piston head 36 presses against the second side 42 of the propeller 38, the propeller will make contact with the pads 22 and 24. Thus, the propeller will be straightened by the pressure of the piston head 36 and the pads 22 and 24.

Unlike prior art arbor presses which have opposed surfaces of substantially equal length (see FIG. 1), the present invention is constructed with the first inner surface 16 extending beyond the end of the second inner surface 18, as seen in FIG. 2A. Because the arbor press 12 has an extended first inner surface 16, the arbor press can precisely exert large enough forces to straighten the propeller. Thus, the propeller 38 does not have to be precisely positioned. Instead, the arbor press 12 may be precisely positioned around the propeller, and can exert sufficient force to straighten the propeller. The arbor press 12 is positioned so that the concave side 40 of the propeller is in the arbor press 12 with the edge of the bent portion of the propeller resting against the pads 22 and 24. The position of the pad 24 may be adjusted, as will be discussed in detail below. The ram 26 applies pressure to the convex side of the propeller 38 when activated. Thus, pressure is applied to the propeller 38 at three points, namely the points where the pads 22 and 24 and the piston head 36 contact the propeller 38. The increased length of the first surface 16 allows the arbor 12 to be placed in a precise position so that the straightening procedure will be effective.

In addition, the increased length of the first surface 16 allows a greater moment arm between the first pad 22 and the piston head 36. As is well known by those of skill in the art, this allows a greater force to be exerted on the propeller 38 without the need for a larger ram and greater reinforcement ridges as required by prior art arbor presses. If the ram 26 were positioned halfway between the pads 22 and 24, the force exerted by the ram 26 when activated would be equally distributed between the two pads 22 and 24. However, if the ram 26 were located closer to the pad 24, a greater proportion of the force exerted by the ram 26 when activated would be applied to the portion of the propeller 38 between the ram 26 and the pad 24. For example, if the ram 26 were located closer to pad 24 so that the distance between the ram and the pad 22 is three times the distance between the ram 26 and the pad 24, three quarters of the force exerted by the ram 26 would be applied to the portion of the propeller between the ram 26 and the pad 24, while one quarter of the force exerted by the ram 26 would be applied to the portion of the propeller between the ram 26 and the pad 22. In the presently preferred embodiment, the length that the first surface 16 extends beyond the end of the second surface 18 is approximately two to three times the distance separating the two surfaces 16 and 18. It should be noted that the greater the amount of extension of the first surface 16, the greater the increase in the moment arm when the ram 26 is activated. However, there are practical limitations to the length of the first surface 16. If the first surface 16 is too long, the apparatus 10 will be too difficult to manipulate above or below the surface of the water.

Figure 2D:
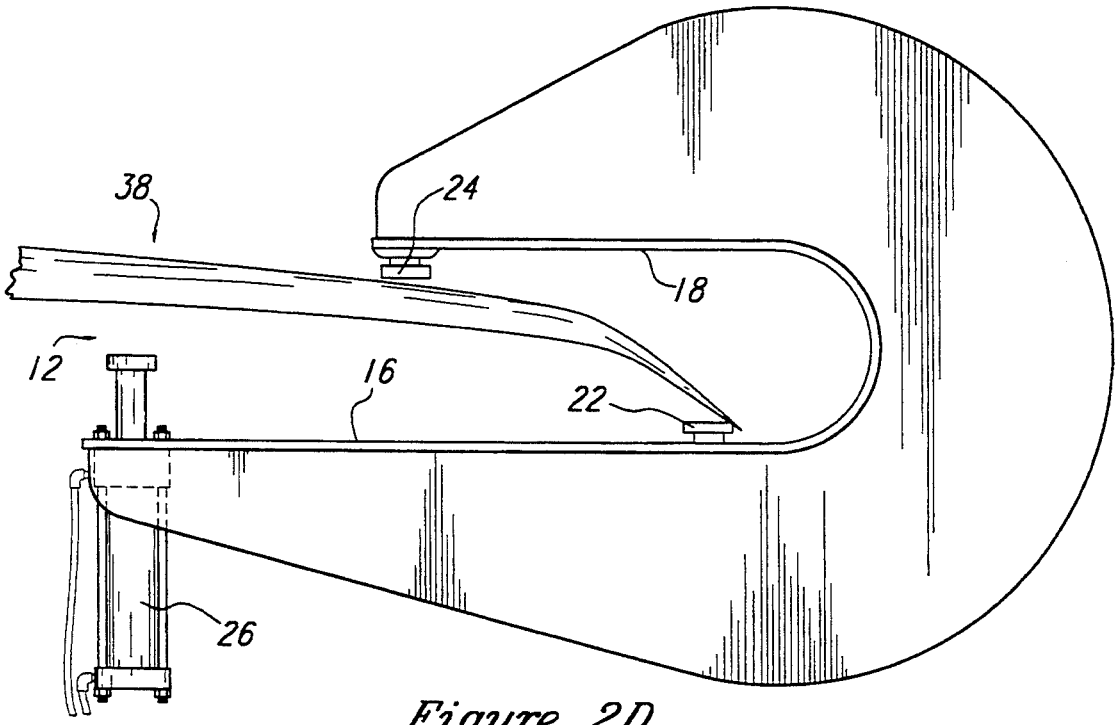
FIG. 2D is a side view of an alternative embodiment of the present invention.

It should be noted that the above description depicts the pad 22 and 24 as mounted on the extended first surface 16. However, the ram may also be mounted on the extended first surface 16 instead of the pads 22 and 24, as seen in FIG. 2D. In this embodiment, the pad 22 and the ram 26 are mounted on the first inner surface 16, with the ram 26 being mounted at the end of the first inner surface 16. The pad 24 is mounted at the end of the second inner surface 18. While this embodiment is not the presently preferred embodiment, the apparatus may still be used effectively because the ram 26 is still applying force to the propeller 38 with a moment arm developed between the ram 26 and the pad 24. Alternatively, the position of the pad 22 and the ram 26 may be reversed on the first inner surface 16, with the pad 22 mounted at the end of the first inner surface 16.

Figure 3:
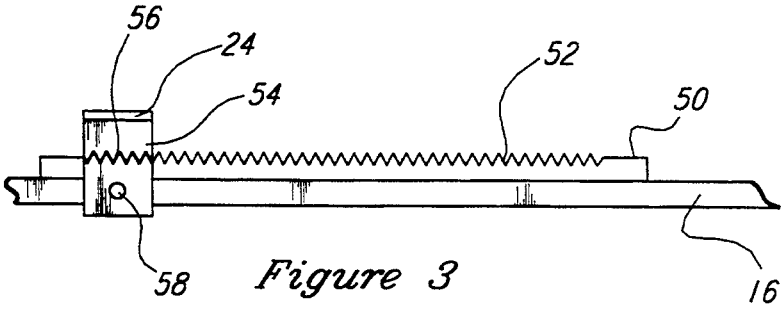
FIG. 3 is a detailed view of a pad adjustment mechanism used on the present invention.

As previously discussed, the second pad 24 may be slidably mounted on the first inner surface 16. Because the length and amount of bend in the damaged propeller is variable, the pad 24 can be moved to more precisely locate the pressure point created by the pad 24. As discussed above, the principles of mechanics dictate that the pressure applied to portions of the propeller depends on the relative distances between the pads 22 and 24 and the ram 26. Because the position of the pad 24 may be adjusted, the amount of force applied to portions of the propeller 38 may be correspondingly adjusted. The tip of the propeller 38 is generally thin in comparison to the base portion of a blade of the propeller. The adjustment of the pad 24 allows a great force to be applied to the bent tip of the propeller to straighten the tip and not bend or distort the rest of the propeller. As best seen in FIG. 3, a fixed base 50 is mounted to the first inner surface 16. The fixed base 50 may be welded to the first inner surface 16 or fastened by any other means such as bolts or screws. The fixed base 50 is fixed in position on the first inner surface 16. The top of the fixed base 50 has a corrugated upper surface 52 to hold the pad in position when the ram 26 is activated. The pad 24 is mounted on an adjustable base 54, which has a corrugated bottom surface 56 to mate with the corrugated upper surface 52 of the fixed base 50. A locking device 58, such as a thumbscrew, is used to tighten the adjustable base 54. When the locking device 58 is tightened, the corrugated upper surface 52 of the fixed base 50 and the corrugated lower surface 56 of the adjustable base 54 are locked in position. The corrugated surfaces 52 and 56 prevent the adjustable base from slipping when the ram 26 is activated.

Figure 4A:
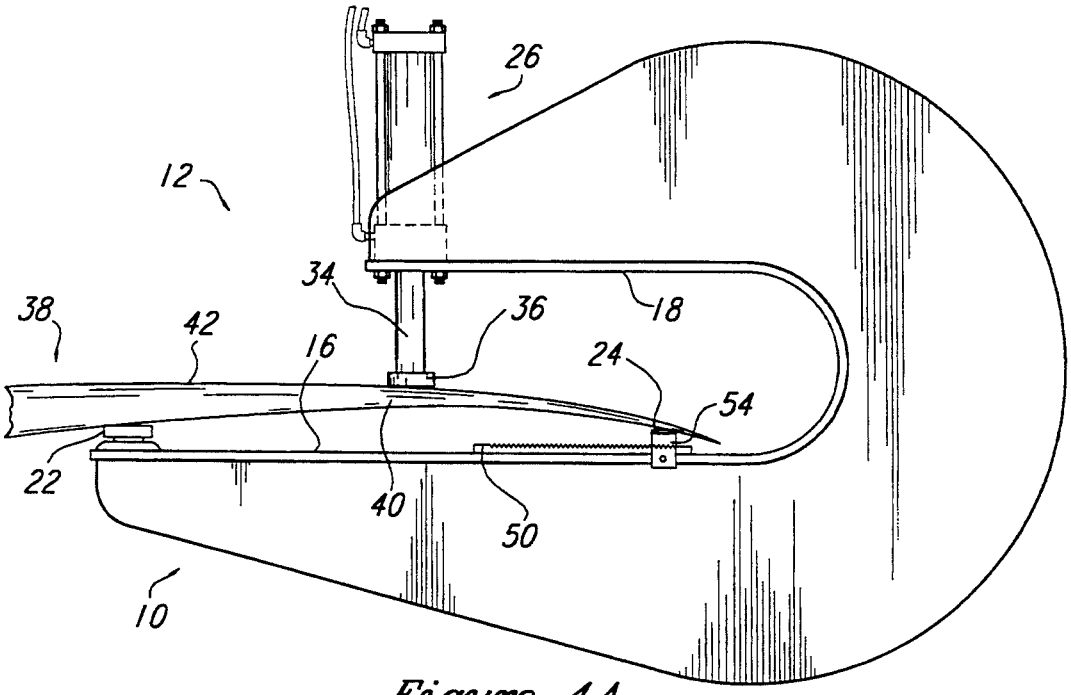
FIG. 4A illustrates an example of the use of the pad adjustment mechanism of FIG. 3.

In operation, the locking device 58 is loosened to allow the adjustable base 54 to be position on the fixed base 50. The precise position of the adjustable base 54 depends on the type of damage to the propeller 38. As seen in FIG. 4A, a long, shallow bend in the propeller requires that the pads 22 and 24 be spaced apart at a maximum distance. The locking device 58 (see FIG. 4) is loosened to allow the adjustable base 54 to be moved to the maximum distance from the pad 22. The locking device 58 is tightened to lock the adjustable pad 24 into position for the propeller straightening procedure.

Figure 4B:
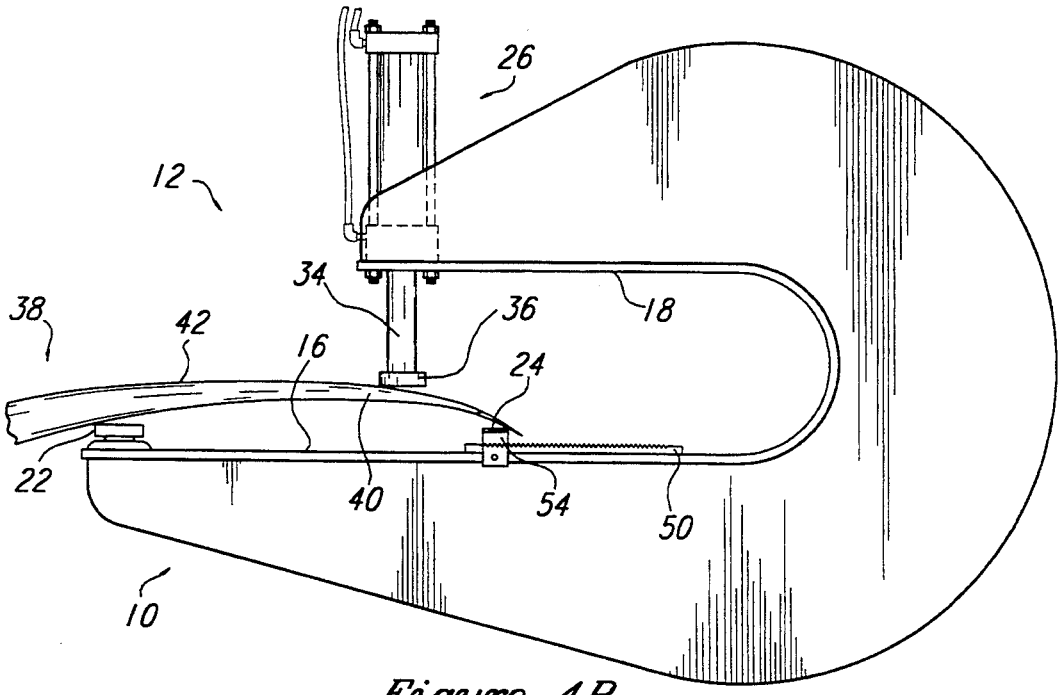
FIG. 4B illustrates a second example of the use of the pad adjustment mechanism of FIG. 3.

In contrast, a small bend in the propeller 38 requires that the pads 22 and 24 be more closely spaced apart, as seen in FIG. 4B. As described above, the locking device 58 is loosened to allow the adjustable base 54 to be positioned near the pad 22. When the locking device 58 is tightened, the adjustable base 54 is locked into position for the propeller straightening procedure. While the present example depicts pad 24 as the adjustable pad, it is clear that the pad 22 may be adjustable instead of pad 24. Alternatively, both pads 22 and 24 may be adjustable.

The propellers of a large ship are themselves very large. Even though a propeller may be straightened, the straightening process requires a large device capable of exerting a great deal of pressure. Such a device is massive and difficult to manipulate. The present apparatus 10 weighs approximately 275 pounds. An apparatus of this weight can be difficult to manipulate with the precision required to straighten a bent propeller. To allow the manipulation of the apparatus 10 under the surface of the water, the arbor press 12 is surrounded by a floatation collar 60, as shown in FIG. 2A. The floatation collar 60 may comprise of a single piece of buoyant material such as closed cell foam. Alternatively, the floatation collar 60 may comprise multiple pieces of closed cell foam positioned around the arbor press 12. The closed cell construction of the foam provides protection against water logging. If a reinforcement ridge 20 is used on the apparatus 10, the floatation collar 60 may be positioned about the reinforcement ridge 20. In the presently preferred embodiment, the floatation collar 60 is comprised of multiple pieces of foam with a density of approximately five pounds per cubic foot. The pieces of foam are cut to fit around the reinforcement ridge 20 and enclosed in fiberglass. The fiberglass protects the foam from damage and provides additional protection against water logging. As previously discussed, the water-tight enclosure 23 (see FIG. 2B) may also provide additional buoyancy if two reinforcement ridges 20 are used.

The floatation collar 60 has sufficient buoyancy to counteract the weight of the apparatus 10 under the surface of the water. However, the apparatus 10 may still be difficult to manipulate with precision. If the center of buoyancy does not coincide with the center of gravity, the apparatus 10 would be unstable and prone to toppling over as it is manipulated. This instability, is unacceptable for the precision manipulation required for the propeller straightening procedure. To allow precision manipulation, the floatation collar 60 is positioned so that the center of buoyancy is substantially the same point as the center of gravity of the apparatus 10. Because the center of buoyancy coincides with the center of gravity, the apparatus 10 is stable under the surface of the water. This allows a single diver to manipulate the apparatus 10 with the precision required to straighten the propeller 38.

Figure 5A:
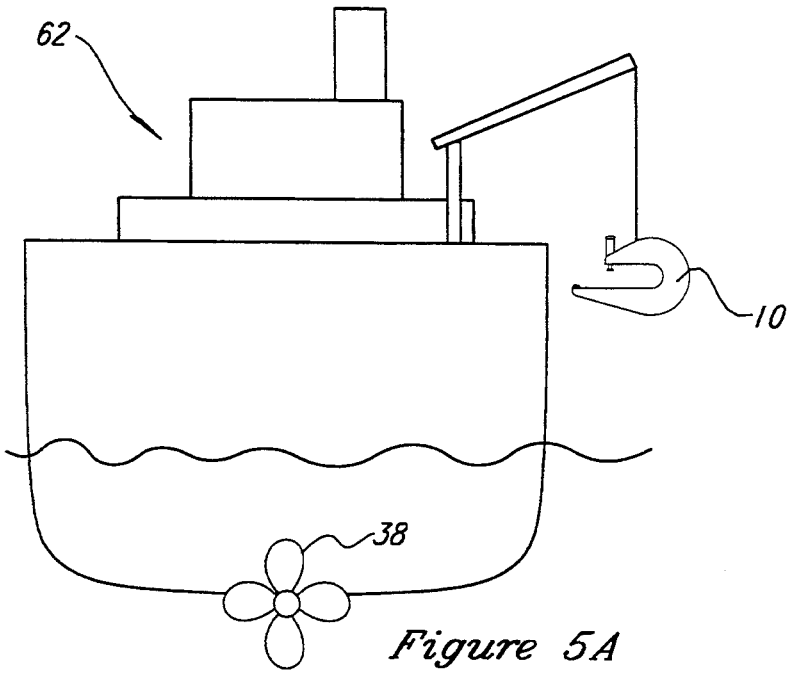
FIG. 5A is an environmental view of the inventive apparatus being lowered into the water.
Figure 5B:
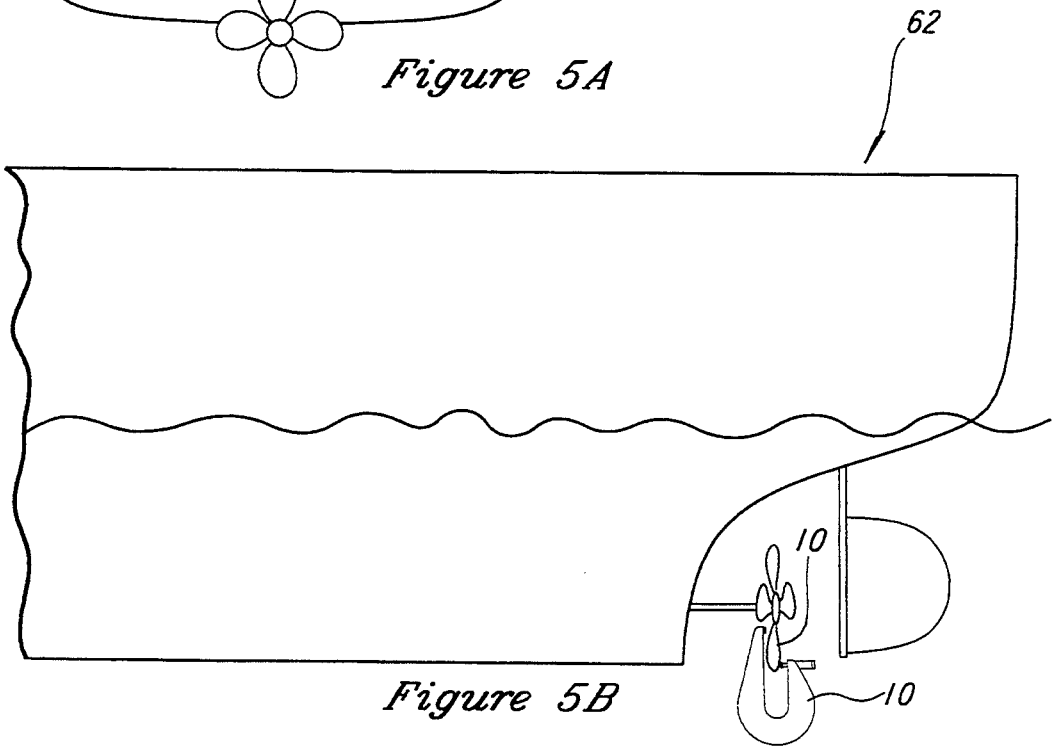
FIG. 5B is an environmental view illustrating the placement of the apparatus around the propeller.

In operation, the apparatus 10 is lowered over the side of the ship 62 and into the water as shown in FIG. 5A. The apparatus 10 may be lowered by a number of techniques well known to those skilled in the art. One such way is using a block and tackle. The apparatus 10 may also be lowered into the water from a nearby ship or from a pier. The diver manipulates the arbor press 12 so that a bent portion of the propeller 38 is positioned between the opposed inner surfaces 16 and 18, as shown in FIG. 5B. The pads 22 and 24 are placed against the first side 40 of the propeller. The adjustable pad 24 may be moved to more precisely control the straightening procedure. When the pad 24 is properly adjusted, the diver or assistant activates the ram 26 to apply pressure to the third pressure point. The propeller 38 is pressed between the piston head 36 and the pads 22 and 24. As a result of the pressure, the propeller blade is straightened. If required, the diver may move the apparatus to other portions of the propeller that require straightening. In the presently preferred embodiment, the hydraulic ram is controlled by an assistant above the surface of the water. The diver communicates to the assistant by radio. Alternatively, the hydraulic controls may be attached to the apparatus 10 to allow the diver to activate the ram 26.

In this manner, an entire propeller blade may be straightened underwater without the need for the expensive dry-docking procedure. The result is that there is a significant savings in the cost of repair, and the ship is returned to service in less time. If the propeller is removed or the ship placed in dry-dock, the inventive apparatus still has significant mechanical advantages over the prior art. It is to be understood that even though various embodiments and advantages of the present invention have been set forth in the foregoing description, the above disclosure is illustrative only, and changes may be made in detail and yet remain within the broad principles of the present invention. Therefore, the present invention is to be limited only by the appended claims

What is claimed is:

1. A method of straightening a propeller under the surface of the water, comprising the steps of:

(a) placing an arbor press around a bent portion of the propeller, said arbor press having first and second opposed surfaces substantially parallel to each other and at a sufficient distance from each other to allow a propeller blade to fit between said first and second opposed surfaces, and a floatation collar positioned around said arbor press, said collar having sufficient buoyancy to substantially counteract the weight of the apparatus under the surface of the water and having a center of buoyancy that substantially coincides with a center of gravity of the apparatus;

(b) bracing first and second pads positioned on said opposed surfaces against the propeller to generate first and second pressure points against the bent portion of the propeller; and (c) activating a ram piston positioned on one of said opposed surfaces to generate a third pressure point against the bent portion of the propeller to straighten the bent portion of the propeller by pressing two of said pressure points against a first side of the bent portion of the propeller and the remaining one of said pressure points against a second side of the bent portion of the propeller to straighten the bent portion of the propeller between said pressure points.

2. The method of claim 1, further including the step of adjusting the spacing between said first and second pads to control the the position of said first and second pressure points relative to said third pressure point.

3. The method of claim 1 wherein said first pad is slidably mounted on one of said opposed surfaces, the method further including the step of adjusting said first pad to control the position of said first pressure point on the propeller relative to said second and third pressure points.

4. The method of claim 1 wherein said arbor press includes a corrugated stop mounted in a fixed position on said one opposed surface and a corrugated surface on said first pad to mate with said corrugated stop to prevent slippage of said first pad when said ram press is activated, the method further including the step of adjusting said first pad to control the position of said first pressure point on the propeller relative to said second and third pressure points.

5. The method of claim 1 wherein said ram piston is hydraulically activated.

6. A method of straightening a propeller under the surface of the water, comprising the steps of:

(a) lowering the apparatus into the water;

(b) moving the apparatus to a position proximate to the propeller;

(c) positioning an arbor press around a bent portion of the propeller, said arbor press having first and second opposed surfaces substantially parallel to each other and at a sufficient distance from each other to allow a propeller blade to fit between said first and second opposed surfaces, and a floatation collar positioned around said arbor press, said collar having sufficient buoyancy to substantially counteract the weight of the apparatus under the surface of the water and having a center of buoyancy that substantially coincides with a center of gravity of the apparatus;

(d) bracing first and second pads positioned on said opposed surfaces against the propeller to generate first and second pressure points against the bent portion of the propeller; and (e) activating a ram piston positioned on one of said opposed surfaces against the propeller to generate a third pressure point against bent portion of the propeller to straighten the bent portion of the propeller by pressing two of said pressure points against a first side of the bent portion of the propeller and the remaining one of said pressure points against a second side of the bent portion of the propeller to straighten the bent portion of the propeller between said pressure points.

7. The method of claim 6, further including the step of adjusting the spacing between said first and second pads to control the position of said first and second pressure points relative to said third pressure point.

8. The method of claim 6 wherein said first pad is slidably mounted on one of said opposed surfaces, the method further including the step of adjusting said first pad to control the position of said first pressure point on the propeller relative to said second and third pressure points.

9. The method of claim 6 wherein said arbor press includes a corrugated stop mounted in a fixed position on said one opposed surface and a corrugated surface on said first pad to mate with said corrugated stop to prevent slippage of said first pad when said ram press is activated, the method further including the step of adjusting said first pad to control the position of said first pressure point on the propeller relative to said second and third pressure points.

10. The method of claim 6 wherein said ram piston is hydraulically activated.

11. A method of straightening a propeller, the method comprising the steps of:

(a) placing an arbor press around a bent portion of the propeller, said arbor press having first and second opposed surfaces substantially parallel to each other and at a sufficient distance from each other to allow a propeller blade to fit between said first and second opposed surfaces, said first opposed surface extending beyond said second opposed surface;

(b) bracing a first and second pads positioned on said opposed surfaces against the propeller to generate first and second pressure points against the bent portion of the propeller; and (c) activating a ram piston positioned on one of said opposed surfaces against the propeller to generate a third pressure point against the bent portion of the propeller to straighten the bent portion of the propeller by pressing two of said pressure points against a first side of the bent portion of the propeller and the remaining one of said pressure points against a second side of the bent portion of the propeller to straighten the bent portion of the propeller between said pressure points.

12. The method of claim 11, further including the step of adjusting the spacing between said first and second pads to control the position of said first and second pressure points relative to said third pressure point.

13. The method of claim 11 wherein said first pad is slidably mounted on one of said opposed surfaces, the method further including the step of adjusting said first pad to control the position of said first pressure point on the propeller relative to said second and third pressure points.

14. The method of claim 11 wherein said arbor press includes a corrugated stop mounted in a fixed position on said one opposed surface and a corrugated surface on said first pad to mate with said corrugated stop to prevent slippage of said first pad when said ram press is activated, the method further including the step of adjusting said first pad to control the position of said first pressure point on the propeller relative to said second and third pressure points.

15. The method of claim 11 wherein said ram piston is hydraulically activated.

* * * * *